United States Patent [19]

Rankin

[11] 4,090,573

[45] May 23, 1978

[54] WIRELINE SEALING APPARATUS AND METHOD FOR USE WITH A DRILL STRING

[75] Inventor: E. Edward Rankin, Great Yarmouth, England

[73] Assignee: Petro-Data C.A., Dallas, Tex.

[21] Appl. No.: 715,328

[22] Filed: Aug. 18, 1976

[51] Int. Cl.[2] ..... E21B 47/024; E21B 33/08

[52] U.S. Cl. ..... 175/45; 166/82; 166/84; 175/214; 277/72 FM

[58] Field of Search ..... 175/45, 214, 61, 173, 175/202; 166/82–84, 315, 255; 285/98; 277/17–21, 72 FM

[56] References Cited

U.S. PATENT DOCUMENTS

| | | | |
|---|---|---|---|
| 3,718,194 | 2/1973 | Hering et al. | 175/45 |
| 3,762,725 | 10/1973 | Taylor | 166/84 X |
| 3,804,168 | 4/1974 | Marshall | 175/214 X |
| 3,939,910 | 2/1976 | Bruce | 166/84 |

*Primary Examiner*—Ernest R. Purser
*Assistant Examiner*—William F. Pate, III
*Attorney, Agent, or Firm*—Wofford, Felsman, Fails & Zobal

[57] ABSTRACT

An apparatus and method for use during earth boring operations when a wireline instrument is positioned within the drill string while drilling fluid is circulated, such as during directional drilling. The apparatus includes a circulating head connected to the top of the drill string that is connected to the drilling fluid pump. A wireline sealing apparatus is connected to and extends partially into the inner passage of the circulating head. The wireline sealing apparatus is of the type that has a flow tube closely fitted about the wireline and in communication with grease supplied under high pressure. The grease provides a seal while the line is stationary and while moving. Consequently, after the wireline instrument reaches the bottom of the drill string, the wireline may be pulled upward while drilling fluid is being circulated to remove slack. The wireline instrument also may be lowered and retrieved while drilling fluid is being circulated.

12 Claims, 6 Drawing Figures

WIRELINE SEALING APPARATUS AND METHOD FOR USE WITH A DRILL STRING

BACKGROUND OF THE INVENTION

1. Field of the Invention

This invention relates in general to wireline operations during earth boring, and in particular to a wireline sealing apparatus and method for use with a wireline directional indicating instrument lowered within the drill string during directional drilling operations.

2. Description of the Prior Art

Many wells are directionally drilled, that is oriented at a given angle with respect to the vertical and in a designated direction. This technique is used frequently in offshore petroleum drilling, where up to sixty wells may be drilled from a single platform at angles of deviation up to about 58°. Each well is drilled vertically to a selected depth, then the angle and direction of drilling is changed from time to time until the precise point is reached. One method of changing the orientation is to use a hydraulic drill bit which contains offset jets to cause the borehole to wear in a particular direction. Under this technique, the drill string is not rotated. An orienting or directional indicating instrument may be lowered into the drill string on a wireline to continuously indicate the direction and angle as the drill string advances. The directional signal can be monitored uphole while drilling. Once the desired orientation is achieved, which may take four or five stands of drill pipe, the drill string is pulled and a conventional drill bit is attached for conventional rotary drilling until the orientation is desired to be changed again.

In order to be able to circulate drilling fluid while the wireline instrument is located downhole within the drill string, conventionally a circulating head is placed at the top of the drill string, and a wireline pack-off is placed on top of the circulating head. Drilling fluid from the pumps is connected to the side of the circulating head. The wireline pack-off is a rubber element type having rams that squeeze the elements against the wireline to seal against the drilling fluid pressure and the drill string. When closed, the line may not be moved, otherwise the seal will be broken and grooves cut into the rubber elements. Normally, while the wireline instrument is being lowered into the well and being retrieved, since circulation can not be maintained simultaneously, the drill bit is positioned one joint off bottom to prevent sticking. Once the wireline instrument is in its proper position in the drill string, the pack-off is actuated, the drill string is lowered until the bit is on bottom and circulation resumed until the stand of drill pipe in the derrick is drilled down.

One disadvantage of this technique is that it has been impossible to entirely remove slack from the line. Due to the light weight of the wireline instrument, friction between the line and the drill string, and other factors, the lower portion of the wireline is under little tension and tends to coil. The upper portion of the wireline may be under satisfactory tension because of the weight of the wireline itself. However, there is little line weight near bottom and the instrument lacks sufficient weight itself to pull the lower portion, which may be several hundred feet or more, tight. Consequently, when drilling fluid circulation is started, the high and pulsating flow rate tends to whip the loose portions of the line, wearing and causing the line to kink and knot. When this occurs, considerable portions of the line have to be discarded.

Another disadvantage is that circulation must be interrupted when the wireline instrument is lowered and retrieved. In certain areas, interrupting circulation for the approximate twenty to thirty minutes required to run the line in or retrieve it can cause the drill pipe to stick in the borehole. The drill string must be lifted one joint from bottom while circulation is discontinued to reduce this possibility. Since this lifting occurs while the wireline is still rigged up and the wireline instrument is downhole, occasionally the wireline catches or snags in the drill rig derrick, kinking or breaking the line. This may mean that several thousand feet of line still downhole has to be discarded.

Wireline sealing devices that allow the line to be moved while the seal is maintained are known. These devices, known as "lubricators", contain a flow tube that fits closely about the line. Grease is injected into the flow tube under pressure to affect the seal. The lubricators are used in cased hole work, normally being connected to the production tubing so that the wireline instrument may be run in a well that is under flowing pressure or will be after the wireline operation. As far as is known, lubricators have not been connected to a drill string for open hole drilling operations, nor used in an arrangement wherein drilling fluid is pumped down from above. Also conventional lubricators extend upward a considerable distance from the connection with the tubing. Because of their height, they could not fit between the top of the drill string and the traveling blocks that suspend the drill string during open hole directional drilling operations.

SUMMARY OF THE INVENTION

It is accordingly a general object of this invention to provide an improved method and apparatus for running a wireline instrument within a drill string in which drilling fluid is to be circulated while the instrument is positioned within the drill string.

It is a further object of this invention to provide an improved apparatus and method for removing slack in a wireline when a wireline instrument is positioned within a drill string in which drilling fluid is to be circulated.

It is a further object of this invention to provide an improved wireline sealing apparatus for connection to the top of a drill string during directional drilling operations that enables slack to be removed from a wireline while borehole fluid is being circulated and while a direction indicating tool is positioned in the drill string.

In accordance with these objects, an apparatus and method is provided that allows tension to be applied throughout the entire length of the wireline while drilling fluid is being circulated. Applicant has discovered that although slack cannot be removed under static conditions because of the light weight of the instrument, the slack may be removed while drilling fluid is being circulated. The downward acting force of the drilling fluid flow tends to push the wireline downward out of the drill pipe. This downward force acts on the entire line, including the lower portion that would normally be loose under static conditions. The downward force creates sufficient drag so that drawing the line upward by the wireline winch while drilling fluid is circulated tightens the entire wireline, removing slack. Once the instrument commences to move upward from its proper position in the drill string, the wireline winch is stopped, and the line is clamped. The drill string may then be lowered to commence directional drilling.

The wireline sealing apparatus that allows the line to be tensioned while drilling fluid is being circulated is of the lubricator type. It is attached to the circulating head, and its grease flow tubes extend down into the circulating head. This minimizes the length of the wireline sealing apparatus above the circulating head, allowing it to be mounted between the circulating head and the blocks. A drilling fluid filter is connected to the flow tubes straining drilling fluid as it is being pumped.

DESCRIPTION OF THE PREFERRED EMBODIMENT

Figure 1:
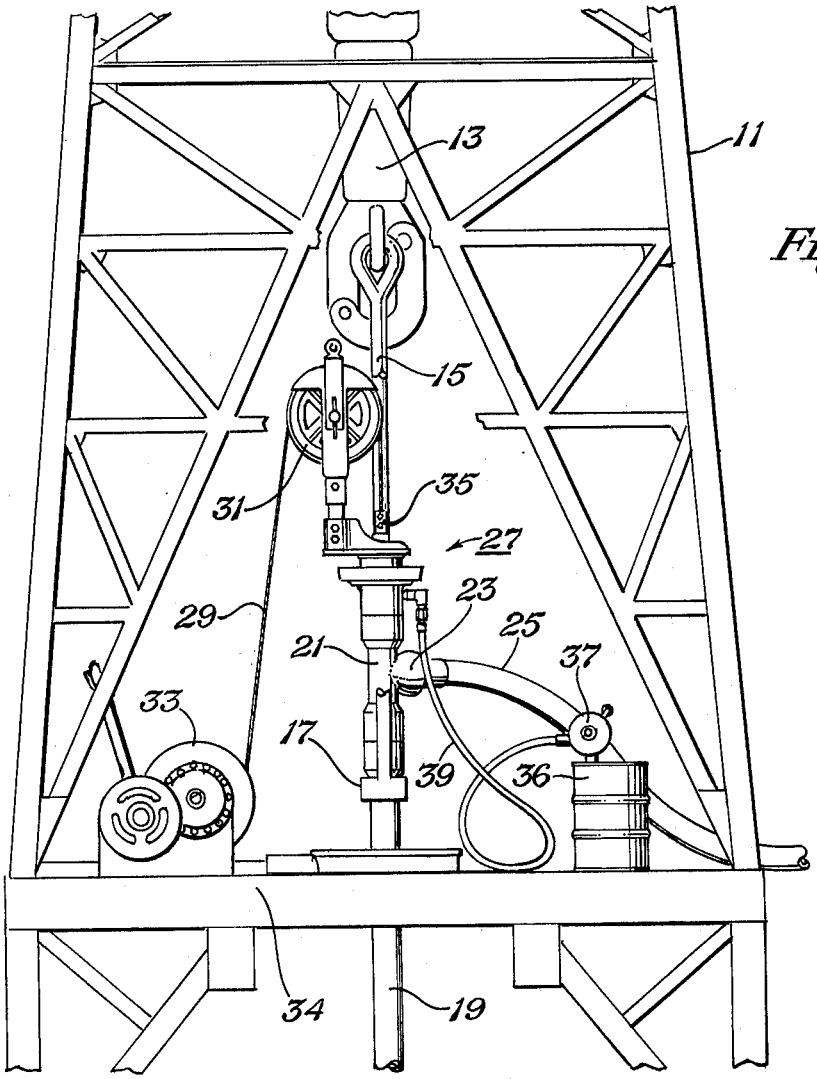
FIG. 1 is a front partial elevational view of a drill rig having the wireline sealing apparatus in accordance with this invention connected to the drill string.

FIG. 1 discloses a schematic of a drilling rig 11, including the blocks 13, bales 15, and elevators 17, which cooperate to raise and lower the drill string 19. A circulating head 21 is connected to the top of the drill string 19. Circulating head 21 has a side connection 23 for connection to the drilling fluid or mud line 25, that in turn is connected to the mud pumps (not shown).

A wireline sealing apparatus 27 is connected to the top of the circulating head 21. A wireline or conductor cable 29 is threaded through a sheave 31 and wireline sealing apparatus 27, and is wound on a winch 33 that is positioned on rig floor 34. The wireline 29 has normally one insulated conductor in the center, with wraps of metal wire surounding the conductor for strength and insulation. The diameter of the wireline 29 is usually three-sixteenth inch to five-sixteenth inch.

A clamp 35 is shown attached to the wireline 29 directly above the wireline sealing apparatus 27. Clamp 35 suspends the line 29, preventing further line from entering the drill string 19. Clamp 35 is of a conventional type comprising two plates having semi-circular vertical grooves (not shown) for the wireline 29 to fit within. The plates are adapted to be bolted together to tighten the line within the grooves. A barrel 36 of grease, with an air operated pump 37, and a grease flow line 39 is connected to the wireline sealing apparatus 27 to effect and maintain the seal. The pump is of the type conventionally used with production lubricators, operating in a range from 40 psi to 80 psi (pounds per square inch) air pressure, delivering approximately 0.25 gallons per minute of grease at 5,000 psi maximum. The maximum speed is approximately 76 cycles per minute. The type of grease used is the same type as used in production lubricators, that is, a heavy duty viscous fluid, such as S.A.E. grade or weight 80–140, or N.L.G.I. Nos. 2–5 (National Lubricating Grease Institute).

Figure 2:
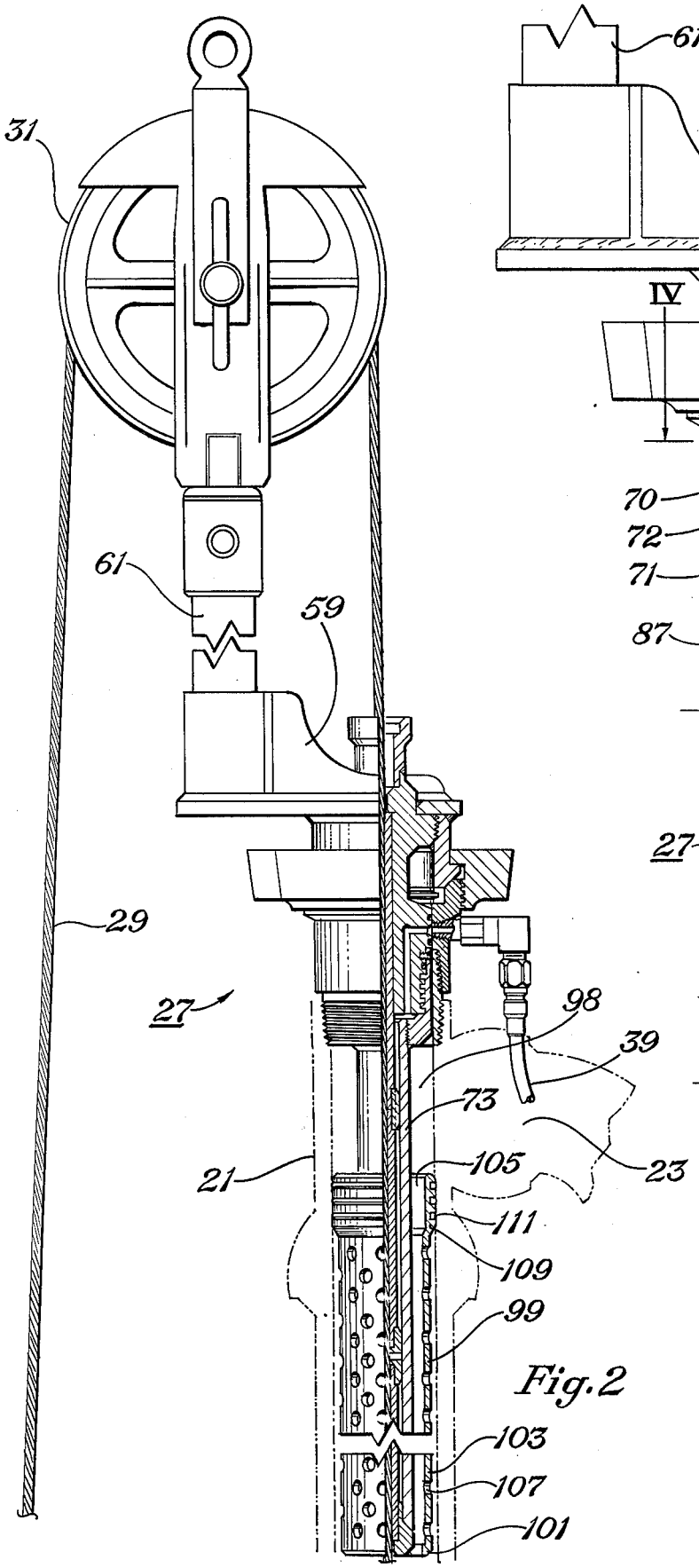
FIG. 2 is an enlarged partial cross-sectional view of the wireline sealing apparatus of FIG. 1.
Figure 3:
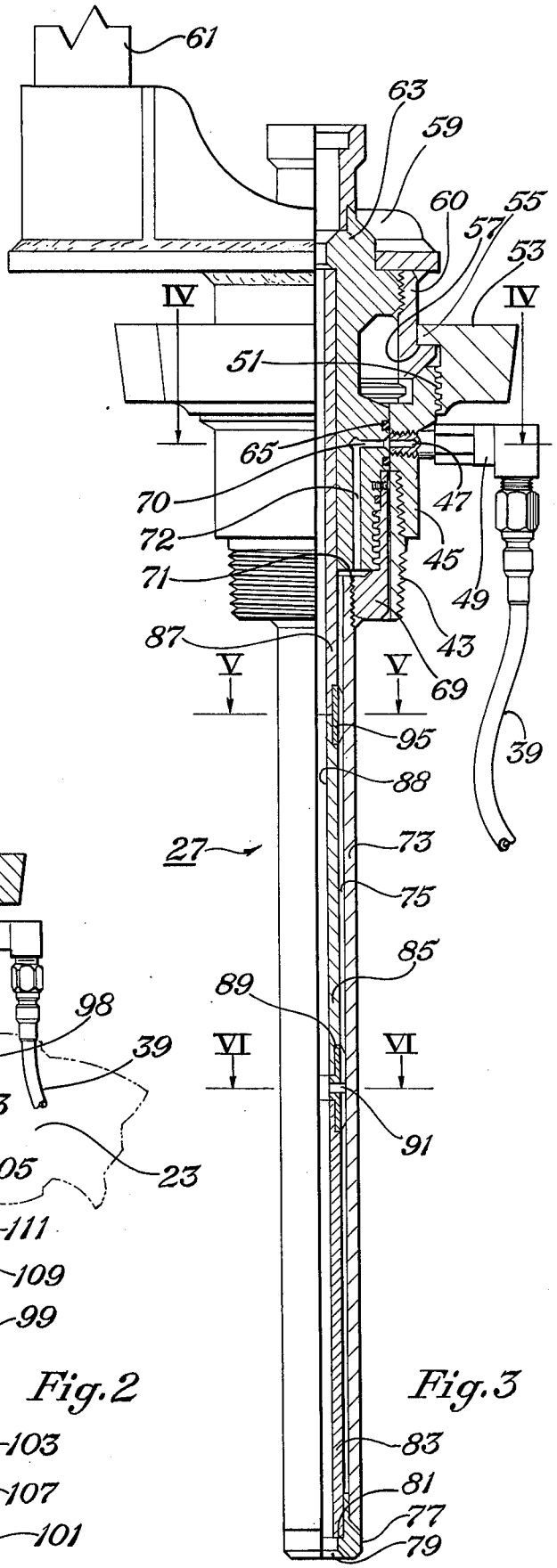
FIG. 3 is a further enlarged partial cross-sectional view of the wireline sealing apparatus of FIG. 1, with the drilling fluid filter removed.

The wireline sealing apparatus 27 is shown in partial cross-section in FIGS. 2 and 3. Referring to FIG. 3, a threaded adapter 43 has lower threads for connection to the circulating head 21, shown in phantom in FIG. 2, and upper threads for connection to a union 45. Union 45 has a threaded port 47 for receiving a grease nipple 49, connected to the grease flow line 39. Union 45 has upper outer threads for connection to a collor 53. Collar 53 has an inner flange 55 that bears against a shoulder 57 of a bracket 59. The lower portion 60 of bracket 59 is cylindrical and bears against union 45. Collar 53 tightens bracket 59 to union 45. Sheave 31 is carried by means of a post 61 inserted in bracket 59.

Figure 4:
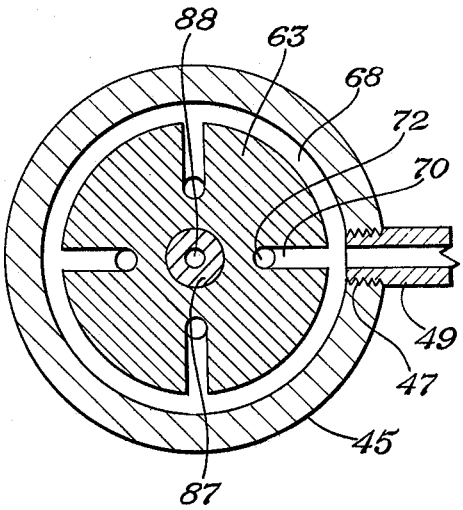
FIG. 4 is a cross-sectional view of the wireline sealing apparatus as shown in FIG. 3 taken along the lines IV—IV.

A flow tube carrier 63 is threaded to inner threads of the lower portion 60 of bracket 59, and extends down through union 45 and part of adapter 43. A pair of O-ring seals 65 on the outer wall of the flow tube carrier 63 seal the surface to the inner walls of union 45. Referring to FIGS. 3 and 4, passage means provide communication from port 47 to the bottom of flow tube carrier 63. The passage means comprises an annular groove 68 through which four radial passages 70 extend to four vertical passages 72.

External threads adjacent the bottom of carrier 63 provide connection to an internally threaded flow tube union 69. The flow tube union 69 has a recess 71 on its upper surface that is in communication with the four vertical passages 72. An outer flow tube 73 is threaded to lower internal threads of the flow tube union 69. The interior 75 of outer flow tube 73 is in communication with recess 71 for the introduction of grease. A cap 77 is welded to the lower end of the outer flow tube 73. Cap 77 has an aperture 79 for the wireline 29 to pass through and a shoulder 81 for carrying a lower inner flow tube 83. Intermediate inner flow tube 85 and upper inner flow tube 87 are positioned on top of the lower inner flow tube 83. The outer diameters of the inner tubes are smaller than the inner diameter of the outer tube 73, leaving an annular space or grease chamber in interior 75 that is sealed at the lower end by cap 77. The inner passages 88 of the flow tubes are only slightly greater than the wireline size, the tolerances being well known in the art of production lubricators.

Figure 6:
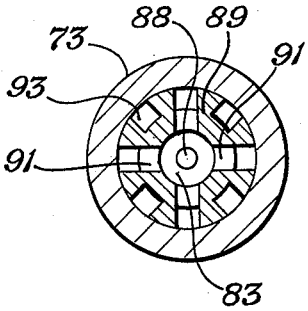
FIG. 6 is a cross-sectional view of the wireline sealing apparatus as shown in FIG. 3 taken along the lines VI—VI.

Lower inner tube 83 is separated from intermediate inner tube 85 by spacer 89 that also serves as a standoff against the interior walls of the outer flow tube 73. As shown in FIG. 6, four radial ports 91 and four vertical slots 93 provide communication from the interior 75 of the outer flow tube 73 to the inner passage 88 of the inner tubes 83, 85 and 87, for providing grease.

Figure 5:
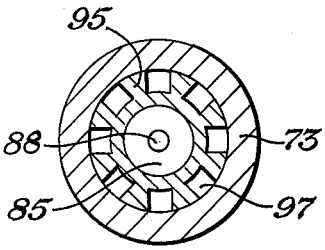
FIG. 5 is a cross-sectional view of the wireline sealing apparatus as shown in FIG. 3 taken along the lines V—V.

A second spacer 95 is located at the junction of the intermediate inner tube 85 with the upper inner tube 87, fitting between reduced end portions of each tube. As shown in FIG. 5, spacer 95 contains vertical slots 97 for the passage of grease. Unlike spacer 93, it does not separate the inner tubes, nor has any radial ports, rather serves as a standoff and connection means.

Referring to FIG. 2, the outer flow tube 73 extends down into an inner axial passage 98 of circulating head 21, shown in phantom. A mud filter 99 is welded or otherwise attached to the bottom of the outer flow tube 73. Filter 99 is not shown in FIG. 3 in order to more clearly show the flow tubes. Filter 99 strains large particles found in the mud that might otherwise damage the hydraulic drill bit at the end of the drill string 19. Mud filter 99 is a cup-shaped, cylindrical member having a bottom 101 connected to the outer flow tube 73 and side walls 103 that extend up around the outer flow tube 73 but do not contact the tube 73. Top 105 is open and terminates slightly below the side connection 23 wherein mud enters. Side walls 103 and bottom 101 contain a plurality of perforations or apertures 107 for the passage of mud, the side walls being smaller in diameter than the inner passage 98 and circulating head 21. An enlarged portion 109 is located at the top 105 and contains O-ring seals 111 to seal against the inner passage 98. The seals force mud to flow through the filter.

The length of the portion of the wireline sealing apparatus 27 that is located within inner passage 98 of the circulating head 21 is approximately 26 inches. The length of the portion of the wireline sealing apparatus 27 that extends above the circulating head, including the sheave 31, is approximately 29 inches. Bales 15 on most large drilling rigs are from 8 to 12 foot in length, thus, leaving ample room for the wireline sealing apparatus to be installed.

In operation, when it is desired to change orientation by using the hydraulic drill bit (not shown), the drill string 19 is made-up with directional equipment and lowered into the well until approximately 30 feet from the bottom of the well. Preferably, drilling during the last trip has been discontinued at the position where a joint connection is approximately level with the rig floor 34. Wireline 29 is fed through the inner passage 88 of the inner flow tubes 83, 85 and 87 and the wireline sealing apparatus 27 is assembled. A conventional wireline direction indicating instrument (not shown) of the type that continuously monitors deviation and direction and supplies a signal for read-out uphole, is then attached to the other end of the wireline 29. One joint of drill pipe is placed in the mouse hole (not shown) and the circulating head 21 made-up on it with the mud line 25 being subsequently attached. The wireline sealing apparatus 27 is connected to the circulating head 21 and the wireline instrument lowered into the joint of drill pipe. This joint is then picked-up and made-up on the top of the drill string, the top connection being preferably positioned two joints up from the rig floor 34.

The wireline instrument is then lowered to the bottom of the drill string, without mud circulation normally, but circulation may be maintained while running in if desired. Once the wireline instrument is on bottom, it is positioned into a slot provided so that it will rotate in unison with the drilling string. Grease must be then supplied to the wireline sealing apparatus 27 to effect and maintain a seal around the wireline. The pressure should be 500–1000 psi greater than mud circulation pressure which typically is approximately 2500 psi. Mud circulation is then commenced and once the circulation rate is established, tension is applied to the wireline by winch 33 to remove slack in the wireline. As much as 15 to 20 feet of slack may be taken-up on the winch in a 9000 foot well. Once the uphole monitor indicates that the instrument has commenced to move upward, the winch is stopped and clamp 35 bolted around the line. The drill string is then lowered to the bottom, oriented in the proper direction as indicated by the wireline instrument, then drilling is commenced. The instrument provides a concurrent surface indication of the angle and direction.

Once the pipe extending into the derrick has been drilled down to approximately rig floor height, (the position shown in FIG. 1) or the desired depth is reached, clamp 35 is removed, and the wireline instrument is pulled to the top of the drill string while the wireline sealing apparatus continues to maintain the seal and while mud is circulated. Once the instrument is at the top, the drill string is pulled up one joint and the wireline sealing apparatus and circulating head, with the uppermost joint, are set into the mouse hole. If more directional changes are required, the procedure is repeated.

It is accordingly seen that an invention having significant improvements has been provided. The method and apparatus avoids the problems caused by slack in the line that previously could not be removed. Circulation may be maintained while the instrument is pulled out or run in if desired, avoiding problems from sticking pipe. The drill bit may be left on bottom as the line is pulled out so that if the uphole line is kinked or broken by snagging or catching in the derrick, the entire downhole line will not be lost. A further advantage is the outer flow tube protects the wireline against the high pressure blast of mud entering the circulation head, and also applies a protective grease coating to the wireline.

While this invention has been described in only one of its forms, it should be apparent to those skilled in the art that it is not so limited, but is subject to various changes and modifications without departing from the spirit or scope thereof. Different types of wireline sealing devices may be employed as long as they are of the type that allows the line to be moved while a seal is maintained, and if they are short enough to fit between the circulating head and the blocks. In the method, if desired, slack can be removed after the drill bit is on bottom and weight has been applied, to compensate for any compression of the drill pipe.

What is claimed is:

1. A method of positioning a wireline instrument for concurrent surface indication within a drill string when drilling fluid is to be pumped down the drill string while the wireline instrument is downhole within the drill string, comprising the following steps:

placing a wireline sealing apparatus at the top of the drill string of the type that maintains a seal while the wireline is moved;

lowering the wireline instrument to the lowest point that it is adapted to reach;

sealing the wireline against pressure within the drill string by means of the wireline sealing apparatus;

pumping drilling fluid down the drill string;

removing slack in the wireline by applying tension to the wireline while the seal is maintained and drilling fluid is being pumped until the position at which the wireline instrument commences to move is reached; and maintaining the wireline within the drill string substantially at said position.

2. The method according to claim 1 wherein the tension is applied by pulling the wireline upward on a winch.

3. A method of removing slack in a conductor cable wireline lowered within a drill string when drilling fluid is to be pumped through the drill string while a wireline instrument is located downhole within the drill string for concurrent surface indication, comprising the following steps:

placing a wireline sealing apparatus at the top of the drill pipe, the wireline sealing apparatus being of the type that seals the wireline against pressure by supplying pressurized viscous fluid around the wireline in an area enclosed by a close-fitting tube so that a seal is maintained while the line is moved;

applying tension to the wireline while the seal is maintained and while drilling fluid is being pumped down the drill string until the wireline instrument commences to move; and maintaining the wireline within the drill string substantially at the position at which the instrument commenced to move.

4. The method according to claim 3 wherein the line is maintained at the position by clamping the wireline at the top of the wireline sealing apparatus.

5. A method of positioning a wireline directional indicating instrument within a drill string to continuously monitor the direction of travel as the drill string is advanced into the earth by means of pumping drilling fluid down the drill string, comprising the following steps:

placing a wireline sealing apparatus at the top of the drill string of the type that seals against pressure by supplying under pressure a viscous fluid around the wireline within a close-fitting tube so that a seal is maintained while the line is moved;

lowering the instrument to its designated position within the drill string;

supplying pressurized fluid to the wireline sealing apparatus to seal the wireline against pressure from within the drill string;

pulling the wireline upward by a winch, while the seal is maintained and while drilling fluid is being pumped, to a position at which the wireless instrument commences to move, thereby removing slack in the wireline; and clamping the wireline at the wireline sealing apparatus to maintain said position within the drill string as the drill string advances into the earth.

6. The method according to claim 5 wherein the viscous fluid supplied to the wireline sealing apparatus is grease.

7. The method according to claim 5 further comprising the step of pulling the wireline instrument to the top of the drill string while drilling fluid circulation is continued and after drilling is discontinued.

8. The method according to claim 5 wherein the drill bit remains on bottom while the wireline instrument is pulled to the top of the drill string.

9. The method according to claim 5 wherein the wireline instrument may be lowered and retrieved selectively while drilling fluid is being circulated and while drilling fluid is not being circulated.

10. An apparatus for removing slack in a wireline positioned in a drill string in which drilling fluid is pumped while the wireline instrument is located downhole within the drill string, comprising:

a circulating head, having an inner passage for drilling fluid flow, connected to the top of the drill string and to the drilling fluid pump;

wireline sealing means, connected to the circulating head, that utilizes pressurized viscous fluid to seal the wireline against pressure within the drill string so that the seal is maintained while the wireline is moving and while stationary; the wireline sealing means comprising an outer flow tube extending downward into the inner passage of the circulating head, the outer flow tube having a chamber for containing pressurized viscous fluid supplied from an internal source, and an inner flow tube carried within the chamber and having a port in communication with the viscous fluid in the chamber, the wireline being received closely within the inner flow tube;

whereby tension may be applied to the wireline to remove slack while drilling fluid is being circulated; the apparatus further comprising: a drilling fluid filter carried by the outer flow tube, the filter having a bottom and cylindrical side walls containing a plurality of apertures for the passage of drilling fluid, the top being open with an enlarged region adjacent the top containing seal means for sealing against the walls of the inner passage of the circulating head so as to force drilling fluid to enter the filter.

11. An apparatus for removing slack in a wireline positioned in a drill string in which drilling fluid is pumped while the wireline instrument is located donwhole within the drill string, comprising:

a circulating head, having an inner passage for drilling fluid flow, connected to the top of the drill string and to the drilling fluid pump;

wireline sealing means, connected to the circulating head, that utilizes pressurized grease to seal an annular area around the wireline against pressure within the drill string so that the seal is maintained while the wireline is moving and while stationary; the wireline sealing means comprising an outer flow tube extending downward into the inner passage of the circulating head, the outer flow tube having a chamber for containing pressurized grease supplied from an external source, and an inner flow tube carried within the chamber and having a port in communication with the grease in the chamber, the wireline being received closely within the inner flow tube;

whereby tension may be applied to the wireline to remove slack while drilling fluid is being circulated; the apparatus further comprising: a drilling fluid filter carried by the outer flow tube, the filter having a bottom and cylindrical side walls containing a plurality of apertures for the passage of drilling fluid, the top being open with an enlarged region adjacent the top containing seal means for sealing against the walls of the inner passage of the circulating head so as to force drilling fluid to enter the filter.

12. An apparatus for use in wireline operations wherein a wireline instrument is positioned within a drill string while drilling fluid is being circulated, comprising:

a circulating head having an inner passage for drilling fluid flow, connected on its bottom to the top of the drill string, on its side to the drilling fluid pump, and having an upper connection;

an outer flow tube extending down into the inner passage of the circulating head, and adapter means for connecting the outer flow tube to the upper connection of the circulating head; the outer flow tube having an inner chamber for receiving pressurized grease, and the adapter means having passage means for the introduction of the pressurized grease;

an inner flow tube carried within the outer flow tube, having a port in communication with the chamber for the introduction of grease; the inner flow tube being adapted to fit closely about the wireline to maintain a seal while the wireline is stationary and while moving, so that the wireline may be drawn upward while the drilling fluid is circulating, for removing slack and for removing the wireline instrument; and a drilling fluid filter carried within the inner passage of the circulating head below the connection to the drilling fluid pump, the filter having side walls containing a plurality of apertures for the passage of drilling fluid, the top of the filter being open and having seal means adjacent the top for sealing to the walls of the inner passage of the circulating head so as to force the drilling fluid to flow through the filter.

* * * * *